United States Patent [19]

Bytheway, Jr.

[11] Patent Number: 4,708,188

[45] **Date of Patent: * Nov. 24, 1987**

[54] CABLE LADDER SYSTEM AND IMPROVED V-CLOSURE BLINDS

[76] Inventor: Mervin H. Bytheway, Jr., 9135 Golden Gate Ave., Orangevale, Calif. 95662

[ * ] Notice: The portion of the term of this patent subsequent to Mar. 24, 2004 has been disclaimed.

[21] Appl. No.: 710,763

[22] Filed: Mar. 15, 1985

Related U.S. Application Data

[63] Continuation-in-part of Ser. No. 593,082, Mar. 26, 1984, Pat. No. 4,651,794.

[51] Int. Cl.[4] ..... E06B 9/26

[52] U.S. Cl. ..... 160/174; 160/166 R; 160/168 R; 160/176 R

[58] Field of Search ..... 160/34, 174–178 E, 160/166, 168, 173, 115, 116, 114

[56] References Cited

U.S. PATENT DOCUMENTS

| | | | |
|---|---|---|---|
| 167,942 | 9/1875 | Seiman | 160/178 F |
| 1,233,781 | 7/1917 | Hough | 160/176 |
| 2,202,752 | 5/1940 | Brenner | 160/173 |
| 3,055,419 | 9/1962 | Rubin et al. | 160/348 |
| 4,076,068 | 2/1978 | Archer et al. | 160/168 R |
| 4,484,612 | 11/1984 | Vecchiarelli | 160/177 |
| 4,494,593 | 1/1985 | Feilder, Jr. | 160/177 |
| 4,503,900 | 3/1985 | Oscka | 160/176 R |

FOREIGN PATENT DOCUMENTS

| | | | |
|---|---|---|---|
| 199578 | 2/1965 | Sweden | 160/173 |
| 265134 | 2/1950 | Switzerland | 160/133 |

*Primary Examiner*—Robert W. Gibson, Jr.
*Attorney, Agent, or Firm*—Mark C. Jacobs

[57] ABSTRACT

A window covering combining the appearance of a pleated shade and a mini-blind, which in the open position resembles a mini-blind and which in the closed position resembles a pleated shade. The desired effect can be achieved by utilizing various combinations of drums, tilt rods and tilters in a mini-blind assemblage in combination with a ladder system comprising two oppositely moving ladders, namely an A ladder and a B ladder.

A means to further diminish light transmission between adjacent slats, when the blind is in the closed position is also disclosed.

The use of an optional double rail construction applicable with any permutation of drums and tilt rods is set forth.

33 Claims, 25 Drawing Figures

CABLE LADDER SYSTEM AND IMPROVED V-CLOSURE BLINDS

RELATION TO OTHER APPLICATIONS

This application is a continuation-in-part of my copending application U.S. Ser. No. 593,082 filed Mar. 26, 1984, now U.S. Pat. No. 4,651,794 the disclosure of which is incorporated herein by reference.

BACKGROUND OF THE INVENTION

Window treatment, namely the art of decorating the interior of a window, has been subject to fashion change over the years. Earlier in the century spring loaded pull up shades and two inch blinds called venetian blinds were in vogue. In the sixties the use of drapes rather than blinds or shades was practiced by the interior decorators of that time. In the early seventies Roman shades, which were rolled up from the bottom toward the top by a drawstring, were considered chic. In the late seventies mini-blinds, i.e. those of one(1) inch depth came into fashion as the preferred window treatment. Today the mini-blind continues to be fashionable along with the pleated shade. Pleated shades are constructed of horizontal pleats of a single piece of fabric. They operate much like the shades of old in that viewing can only take place to the extent that the shades are drawn open, i.e. raised upwardly from the bottom of the window. As is well known, blinds on the other hand offer viewing capability without the necessity of raising them upwardly. The mere traverse or the blind permits the slats to be oriented parallel to one another, thereby letting light in from the window. This is considered an advantage in view of the fact that both children and infirm persons can operate mini-blinds to change the condition from light emitting to light prevention with minimal effort in contrast to the operation of a shade or pleated shade. On the other hand many people find that they prefer the fashion appearance of the pleated shade as opposed to the overlapping slats of the mini-blind during such times as the shades are in the room darkening position.

While attempts have been made to simulate or approach the instant invention, such structures have not been devised previously. Thus reference is made to U.S. Pat. No. 2.049,518 which though entitled Venetian Blind, is in fact a pleated shade.

SUMMARY OF THE INVENTION

A mini-blind which has a unique ladder cable system, comprised of the A ladder and the B ladder, the ladders of which system can be secured to a plurality of ½ function, or single function drums or to a single dual function drum.

In the embodiments wherein all of the drum (s) are mounted on a single tilt rod, and in the embodiments wherein each ladder's drum employs a separate tilt rod, then one of said ladder cables two side cables will cross under the drum for attachment thereto and the other of said ladder's two side cables are conventionally attached to its drum(s).

In embodiments wherein each ladder's side cables are on different single function drums, then both ladder's two side cables are conventionally attached to the drums.

Various permutations of tilt rods, and/or one or two tilters can be employed to give the V-closure effect Optionally a double rail system can be employed, wherein the first is the main or regular bottom rail and the second comprises a modified weighted slat adapted preferably to be of equal weight as the main bottom rail.

The various combinations give rise to an improvement to a mini-blind which appears conventional in the open position, and which appears to be a pleated shade in the closed position.

It is an object, therefore, of this invention to provide a mini-blind which has the operation of a mini-blind with respect to the light passage capability yet retains the fashionable good looks of a pleated shade.

It is another object of this invention to provide a mini-blind that has a higher thermal coefficient that the standard mini-blind.

Another object is to provide a mini-blind that more readily lends itself to the use of different colored alternating slats and to the use of slats which are fabric covered on the top side of one and the bottom side of the adjacent slat.

Another object is to provide a unique mini-blind that in the closed position resembles a pleated shade.

Still another object is to provide a V-closure blind that had an optional double bottom rail feature.

Yet another object is to provide a plurality of systems combining drums, tilt rods and ladders to achieve the V-closure blind effect.

The invention accordingly comprises the product possessing the features, properties and the relation of components which are exemplified in the following detailed disclosure, and the scope of the application of which will be indicated in the claims.

For a fuller understanding of the nature and objects of the invention, reference should be had to the following detailed description taken in connection with the accompanying drawings.

DESCRIPTION OF THE PREFERRED EMBODIMENT

For the ease and convenience of the reader, it was felt that an introduction to the venetian blind, originally introduced in the 1940's, would be of benefit in understanding the instant invention. While we are all familiar with the results of operating a venetian blind, we are not necessarily cognizant of how they in fact operate.

Venetian blinds,defined as blinds having a series of parallel slats that are orientable between an open and a closed position to permit or inhibit passage of light, when first introduced employed slats that were of two (2) inch depth, i.e. from front to rear. More recently however the slat depth has been reduced to one (1) inch and the reference term now used for these is mini-blinds. In this patent application the term blind shall be used, as the invention is independent of the depth of the slat and functions with both types.

Figure 1:
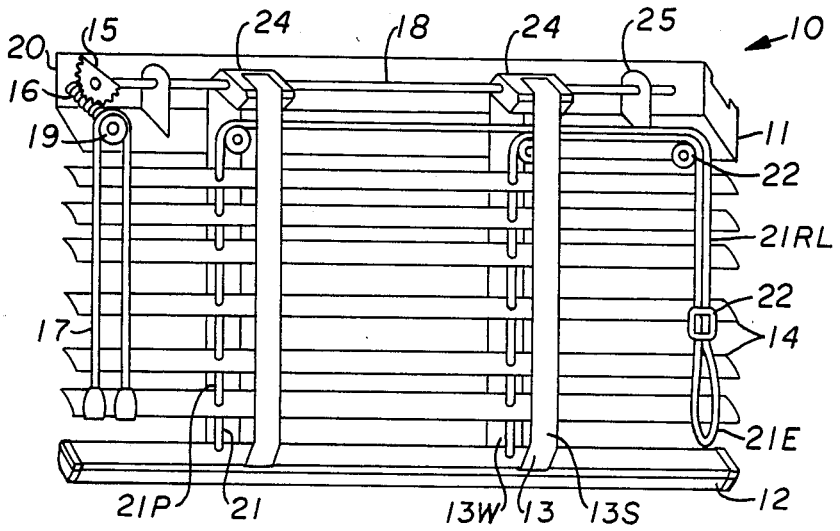
PRIOR ART FIG. 1
FIG. 1 is a front elevational view of a mini-blind of the prior art in the open or light passage position.

In the prior art blind of FIG. 1, an older style blind is shown. This fact is evidenced by the use of a tilt cord 17, rather than the tubular wand now used to open and close the blind. The older style is also evidenced by the use of wide fabric tapes 13. Today, these tapes, are referred to as ladder cables. They are made of braided rope rather than 1" or greater in width fabric, and are disposed outside of the slats of the blind.

Prior to discussing the construction of the prior art and the modern blind, some nomenclature is in order.

Thus it seen that the blind 10 comprises a head section 11 from which are suspended a series of slats 14, the most lower of which is designated the bottom rail 12. These slats are supported on a plurality of ladder-like structures.

A ladder as we generally utilize that term constitutes a plurality of parallel rungs and the side rails that hold the rungs. In the language of the blind trade today, the rungs 14 of these ladder-like structures are referred to as rungs.

The side rails or vertical members of a ladder. As used in this art are designated side tapes. Thus a tape 13 is comprised of side tapes 13S and rungs 13R . These tapes 13 hold the plurality of spaced slats in a spaced relationship parallel to each other in the open position of the blind.

The side tapes 13S are outside of the slats, while the lift cord 21, consisting of segments 21P and 21RL and 21E. Segment 21P is seen passing through the plurality of slats 14, while the designators 21RL is the raising and lowering segment and the 21E segment is the end of the cord.

Unlike a household ladder, the side rails here called side tapes have the Ladders, called rungs, flexibly attached thereto. Reference is made to any prior art venetian blind.

Today these side tapes have as was mentioned above been replaced by braided cord, and the term side tape has been replaced by the term ladder cable, meaning a cable to hold the rung, as discussed above.

Designator 15 is the tilter or tilting gear that engages the worm gear 16 upon actuation by operator movement of the tilt cord 17, or by rotation of a tilt wand as would be employed instead of the tilt cord in the modern blind.

The tilt rod 18, the tilter and worm gear aforesaid and the drums 24 to which the ladder cables 13 are attached at the top, and the cradles 25 are all deployed in a U-shaped channel designated as the head channel or head rail, 20.

Figure 2:
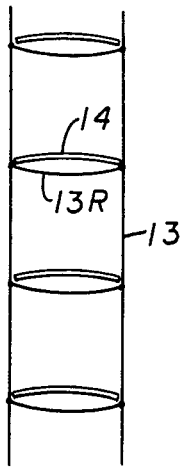
FIG. 2 is an end elevational view of a conventional blind.

In this prior art unit, it is seen that along the width of the blind that two tapes or ladder cables are employed. Each location for a ladder is of a single ladder cable 13 upon whose rungs rest a single slat 14. Reference is made to FIG. 2.

Figure 3:
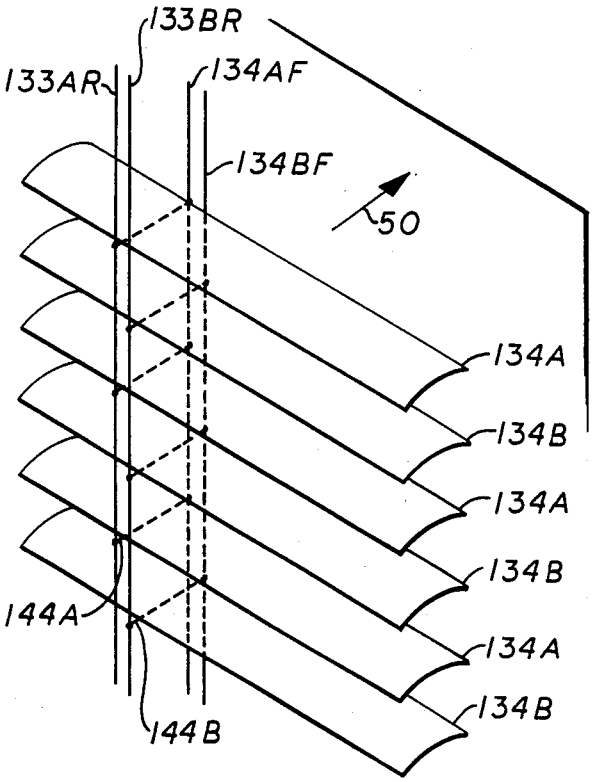
FIG. 3 is a close-up perspective view illustrating the instant invention.

On the other hand, in the instant invention, each drum employs a ladder cable system that constitutes a pair of ladder cables, each of which is positioned adjacent the other. This is, a pair of ladder cables are used at each drum location along the width of the blind. Here one ladder cable is designated 133A while the other is designated 133B. Each of the two ladder cables 133A and 133B each support alternate slats, designated A and B of 134 respectively. Reference is made to FIG. 3. While the distance between slats is the same as in a conventional blind, the distance between adjacent rungs on any one cable is twice that of a conventional ladder, since each ladder cable only supports half of the slats on its rungs.

In FIG. 3 it is to be seen that just as there are A slats and B slats, so, too, are there A and B ladders as aforesaid. It is important to note the second designator, namely F and R. These designate the front and rear side cable of the A and B ladder cables respectively. Arrow 50 points toward the window 51 to correctly position the blind. It should also be understood that the ladder cables in FIG. 3 are discontinuous, i.e. they terminate before the head channel, for ease of understanding. The rungs are designated 144A and 144B corresponding to the cables A or B to which they are knottingly secured.

Figure 4:
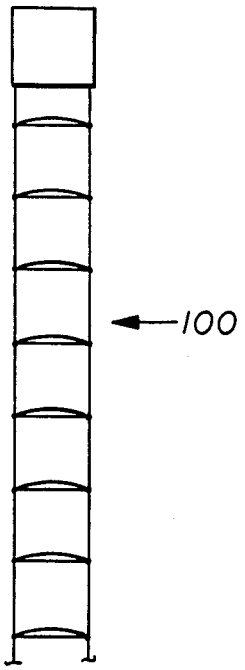
FIG. 4 is a right side elevational view of a mini-blind according to this invention in the open position.

In FIG. 4 there is depicted the blind of this invention in the open position. Here the blind 100 as seen from the right side has the appearance of the prior art blind 10 as described previously. But when the blind is oriented to close the blind, as in FIG. 5, the blind takes on the appearance of a pleated shade in that the front edge of one slat moves to the front edge of the adjacent slat and rear edge of any one slat moves toward the rear edge of any adjacent slat.

Figure 6:
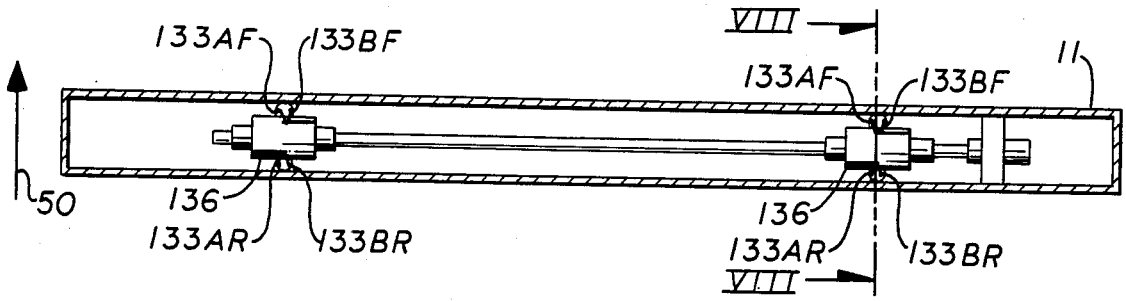
FIG. 6 is a top plan view of the head portion of a blind according to this invention wherein a single dual function drum is employed.
Figure 8:
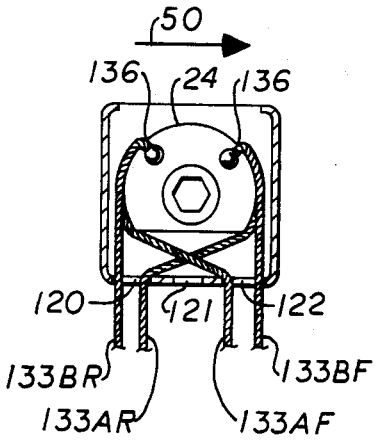
FIG. 8 is a close-up, end view of a dual function drum according to this invention.
Figure 19:
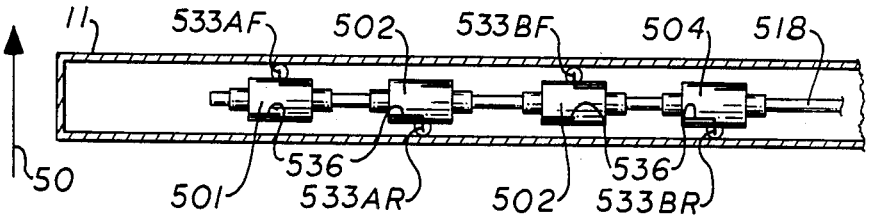
FIG. 19 is a top plan view, fragmented showing the use of four ½ function drums aligned on a single tilt rod.

FIG. 6 , which is a top plan view of a blind's U-channel 20 shows the various components used to operate a blind. It does not show the presence of the ladders on any of the drums not only to keep the Figure from being cluttered, but also because individual drums are shown in FIGS. 8,9, and 10. It is important to understand, that the double function drum employed as in the FIG. 6 embodiment and the single function drum as employed elsewhere herein, are in fact the same drum. Only the number of ladder cables secured to each of same differs. Thus the term ½ function as will be discussed with respect to FIG. 19 below breaks down the number of ladder cables per drum to the absolute minimum, namely one. Whereas the single function has the front and rear of one of the pair of ladders employed, and the dual function has all four (4) cables of both ladders secured thereto.

Figure 7:
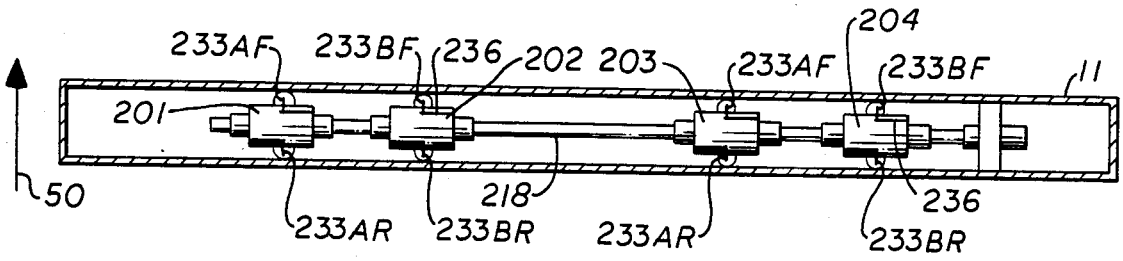
FIG. 7 is a top plan view of the head portion of a V-closure blind two single function drums a used in-line on a single tilt rod.

In my co-pending application referred to previously, I disclosed the use of a single double function drum 24 , seen in FIGS. 7 and 8 to carry out the desired effect of the V-closure blind. In order to show how two single function drums operating together carry out the desired result, it is necessary to briefly explain about the previously embodiment of a blind , which upon inspection would appear from the top as in FIG. 6, thus as was said drum 24, a conventional drum having two slots for conventional cable receiving beads, is seen to receive the rear side cable of the A ladder at the front thereof, and the front side cable of the B ladder. Since the use of these beads is conventional in the art, it is deemed unnecessary to disclose same in the figures or to elaborate further about them, other than to say such beads are drilled to receive the end of the ladder cable, and the beads have disposed thereon a crimp for securing the ladder cable to the bead. These are designated 133 AR and 133 BF respectively. Reference should now be had to FIG. 8 which illustrates how the B ladder shown in dashed lines has its front cable side 133 BF connect to the front of the drum, and its rear cable side 133 BR connect to the rear of the drum. This is the conventional hookup of a ladder in a blind. Observe the A ladder shown in dashes and dots it crosses under the drum 24 within the channel 20 and attaches on opposite sides of the drum.

The designators 120, 121, and 122 all pertain to bores in the bottom wall of the U-channel, through the first and last of which pass the cords of the ladder cables.

Figure 5:
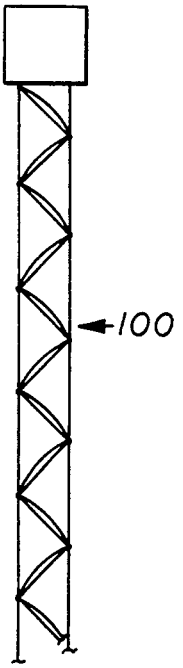
FIG. 5 is a right side elevational view of a mini-blind of this invention in a closed position.
Figure 13:
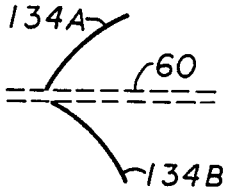
FIG. 13 is a closeup end view of the closed position of a blind according to the invention.

Thus it can be seen how, when tilting the tilter 15, whereby the drum 24 rotates forwardly, the B slats 134B as best seen in FIG. 13 will have their front edges tilt downwardly in the same arcuate pattern as the movement of the drum, while the A slats of this double function drum will move upwardly along their front edge, i.e. they go counter-clockwise to achieve the desired V-closure effect as shown in FIG. 5.

As in conventional blinds, here too, the number of drums employed depends on the width of the shade, as can be easily understood. Wider shades have heavier and wider slats and so they need more support. In the embodiment of FIG. 6 we assume a minimum width for an average window and thus only one drum is shown at each end of the blind. Both of these are double function, that is, each carries an A rung and a B rung. Two drums is the minimum useable, three and four across the span are commonly used in blinds that cover picture windows.

In the embodiments to be discussed below, wherein two single function drums are employed, we also assume a minimum width window such that one pair of single function drums is employed for each one double function drum as shown in FIG. 6. Thus for the embodiments of FIGS. 7, 11 and 12 when they are used in wide windows, totals of 6 and 8 would be employed.

No time has been spent discussing the mode of attachment of the ladder cables to either the single function or double function drums. One technique known in the art, and practised for many years, comprises crimping a bead, not seen, onto the end of each cable and then sliding the bead into a slot such as 136 seen in FIGS. 7 and 8. For single function drums only two ladder cables are so inserted, one for the back and one for the front.

Figure 9A:
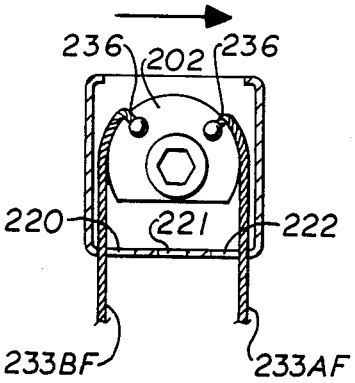
FIGS. 9A and 9B are are closeup end views of the two single function drums employable in this invention.
Figure 9B:
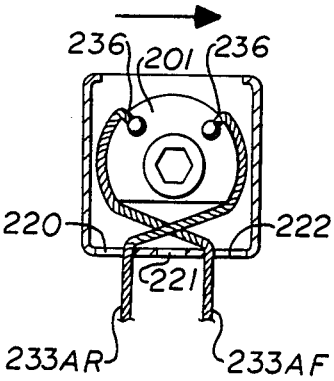
Figure 10:
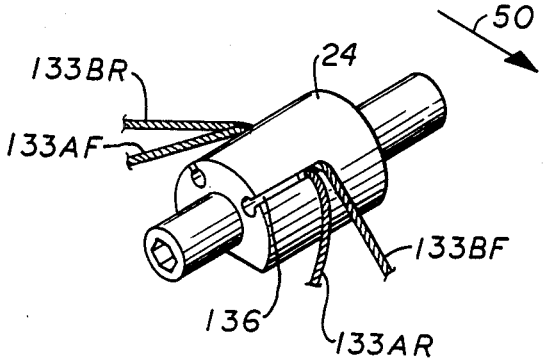
FIG. 10 is a diagrammatic view of a dual function drum utilized in the blind of this invention.

Thus FIG. 9A shows the B front and rear cables designated 133 BF and 133 BR respectively, while FIG. 9B shows the A front and rear cables designated 133 AF and 133 RF respectively Since the drum utilized for both single and double functioning is the same , in FIG. 9 the drum is also designated 201, and 202 respectively Having explained the difference between a single function drum and a double function drum, the discussion can now move on to the disposition of how a pair of single function drums are employed to achieve the V-closure. The term "a pair" is intended to mean a pair at each location, such as two in the minimum width blinds of FIGS. 7,11, and 12.

Reference is once again made to FIG. 6 which as discussed previously shows the placement of both the A and B ladder cables for both the front F and the rear R all bearing the designation 133 appropriately.

In FIG. 7 , a top plan view, similar to FIG. 6 a pair of single function drums are positioned adjacent each other on a single tilt rod 218. (In order to prevent cluttering of the drawing, the tilt gears such as 17 and 18 of FIG. 1 have been omitted, not only in FIGS. 6 and 7 but in FIGS. 11 and 12 as well as 19).

Upon viewing of FIG. 7 it's seen that from left to right four drums numbered 201, 202, 203 and 204 are all mounted on the same tilt rod 218. The designator 236 pertains to the slot for mounting the cables via the beads aforesaid Here the A ladder cables , both front and rear designated 233 AF and 233 AR are secured to drums 201 and 203, while the B ladder cables, 233 BF and 233 BR, wherein F is for front and R is rear, are secured to drums 202 and 204. No particular order is necessary to carry out this arrangement. Thus the B ladder cables could be outboard on both ends or inboard on both ends of the blind. The same is true of the A ladder cables. As elsewhere, arrow 50 points to the front of the blind.

It is important , when reviewing this embodiment and others to follow, as well as the embodiment of FIG. 6 to understand, that the lead lines of the numerical designators point to the descending cable location, more than to the actual cable itself. This is true, since in the interest of maintaining ease of understanding of the location of the several cables in all of these embodiments, one must presume the cross-over of the A cables, not shown here, but which, is distinctly pointed out in FIG. 9B and FIG. 8.

FIG. 8 as has been previously discussed pertains to a double function drum. That is, four ladder cables are secured thereto, two of which descend directly and two of which cross each other prior to the descent. This drum is used in the embodiment of FIG. 6.

In FIGS. 9A and 9B, two single function drums are seen. These are structurally the same as the drum 24 of FIG. 8, which drum has been used for many years. Here however, the drums designated 202 and 201 respectively are utilized in the manner shown in FIG. 7 wherein the B ladder cables descend directly, and the A ladder cables descend in crossed fashion. In this embodiment designators 120, 121, 122, being the same element as previously employed elsewhere herein, and slot 236 here,being the same slot as slot 136 also utilized elsewhere herein. The elements 120, 121 and 122 pertain to bores in the bottom wall of the U-channel. The ladder cables are seen to pass through bores 120 and 122. Bore 121 serves as the exit hole for the lift cable that goes down through the centre of each slat.

Figure 11:
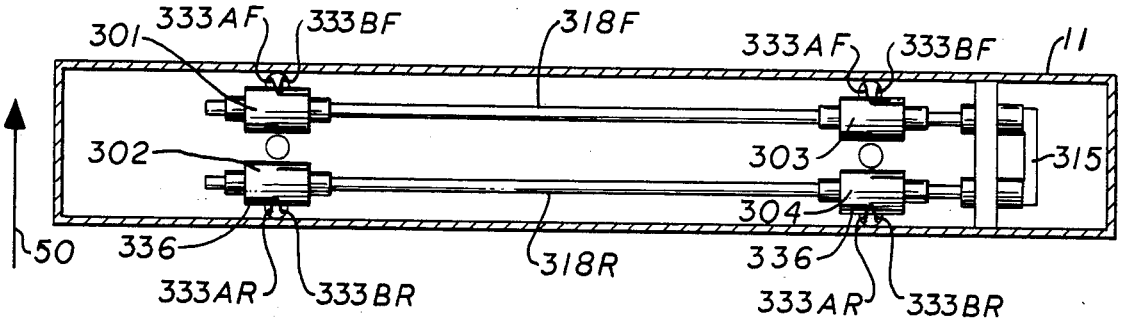
FIG. 11 is a top plan view of one embodiment of this invention wherein two single function drums are utilized one behind the other.

Skipping momentarily over FIG. 10, we turn next to FIG. 11. Operationally, the embodiment of FIG. 11 is the same as that of FIG. 7, in that four single function drums are employed. Here however, rather than being aligned on one tilt rod, they are disposed one behind the other in pairs onto two tilt rods. In this embodiment, the cables are labeled in the 300 series, and are shown disposed on drums 301, 302, 303, and 304. To conform to the nomenclature of arrow 50 pointing to the front of the blind, the tilt rods have been designated 318 F for the front one, and 308 R for the rear one.

Figure 12:
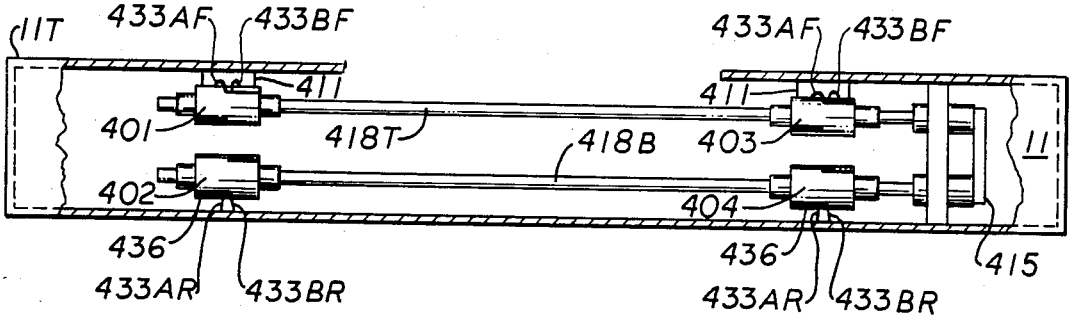
FIG. 12 is a cutaway elevational view of another embodiment of this invention wherein two single function drums are stacked vertically.

The view of the embodiment in FIG. 12 is a cutaway front view rather than a top plan view, since here the four single function drums are disposed one above the other rather tan side by side. The operation is of course the same as in FIG. 11 since two tilt rods are disposed within the head portion 11. Here however, the head portion 11, rather than being open as in conventional blinds, includes a top wall 11T extending inwardly from each end a sufficient amount to be able to receive the drum mount support 411, wherein the support would be disposed around and beneath the drum.

It is to be seen that while the drums 201 and 202 are depicted substantially adjacent each other in FIG. 7, in reality they could be spaced further apart relatively speaking, as much as 6″ or even more, depending on the overall ½ width of the blind, assuming as we have that the blind is sized to only need a ladder system at each end of the blind. This is equally applicable to the embodiment of FIG. 19.

The support has been omitted from these views for the sake of ease of the A ladder front cord 533AF, while drum 502 carries the cord 533 AR the mate thereto, and drum 503 carries cord 533BF and 504 carries cord 533BR. Designator 536 is the slot for the cable mount bead.

Turning now to FIGS. 8 and 10 to explain the operation of the double function drums, which when understood, will suitably render the understanding of the use of two single function drums to carry out the same job easy to comprehend. Thus we note drum 24, a conventional drum having two slots for the reception and carrying of conventional cable receiving beads. In FIG. 10 if we establish that the drum is facing us, and that the window is in the same relative location due to the presence of arrow 50, then adjacent the reader is the front cable of the B ladder cable and the rear cable of the A ladder cable, and their mates are distal from the reader. This is because we are viewing the actual cables as they are mounted on the drum in FIG. 10, and not their disposition after they leave the drum and descend through the bores in the head 11. Reference is made again to FIG. 8 for this purpose.

Since the use of drum slots 136 to receive the beads unseen is conventional further discussion on this aspect is not needed, except to say that the beads are drilled to receive the end of the ladder cable, and are then crimped to secure the ladder cable to the bead, as was discussed above.

Note how in FIG. 8 the B ladder has its front cable 133 BF connect to the front of the drum and its rear cable 133 BR connected to the rear of the drum. ( Observe arrow 50 ) This arrangement is the standard ladder hookup in a prior art blind.

Observe the A ladder. It's cables cross under the drum 24 within the channel 20, and attach on opposite sides of the drum. Since the one drum carries both the A ladder's cables and the B ladder's cables it is referred to as a dual function drum.

Figure 20:
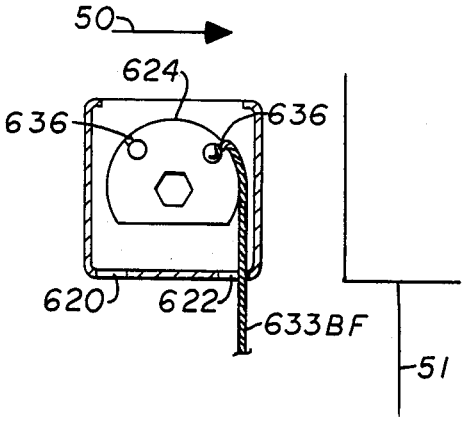
FIG. 20 is a closeup end view of a ½ function drum according to this invention.

Referring again to FIGS. 9A and 9B, it is seen how only one ladder is carried by each drum. Hence the term, single function drum. Now, on reference to FIG. 20, we note a ½ function drum here designated 624 and carrying only one side of a cable ladder , which in this instance is 133 BF. Designator 636 is the same as 136 and 236 aforesaid.

In the text above we have always noted the need to have one pair of cables descend directly from the drum , while the second set of cables descended in a crossed configuration just beneath the drum. Reference is made to the use of the two different single function drums as per FIGS. 9A and 9B.

It has now been found that the V-closure effect can be obtained by using two drums such as shown in FIG. 9A if they are placed either side to side as in FIG. 11 or one above the other as in FIG. 12, if the two drums are tied together by a gear system and the ladder cables are disposed such that one ladder cable of a pair moves up while the other cable of the ladder moves down. One such arrangement for carrying out this result is disclosed in FIGS. 21 and 22.

Figure 22:
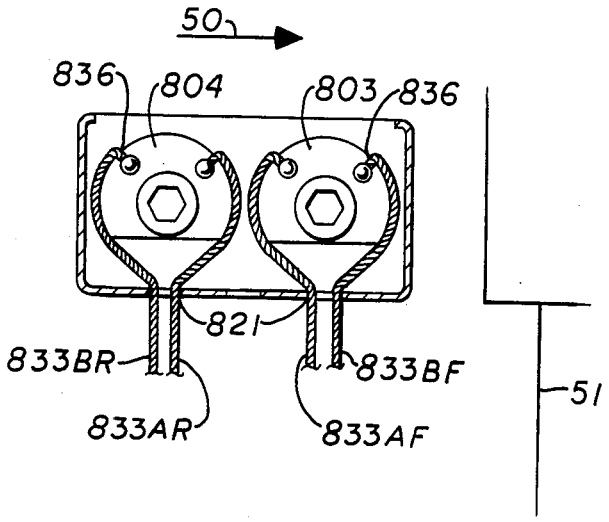
FIG. 22 is a view taken along line X—X of FIG. 21.

Turning first to FIG. 22, it is seen that two drums similar to those of FIG. 9A are shown adjacent each other within head 11. Here designator 836 is for the bead receiving slot for the disposition of the ladder cables. Note how the two drums 804 and 803 both have their two ladder cables descending straight down. The cables are disposed such that the front and rear cables of any one ladder are on opposite sides of different drums within the head 11. Each drum's cables descend through an opening 821 on opposite sides of the unnumbered bore reserved for the lift cord.

Figure 21:
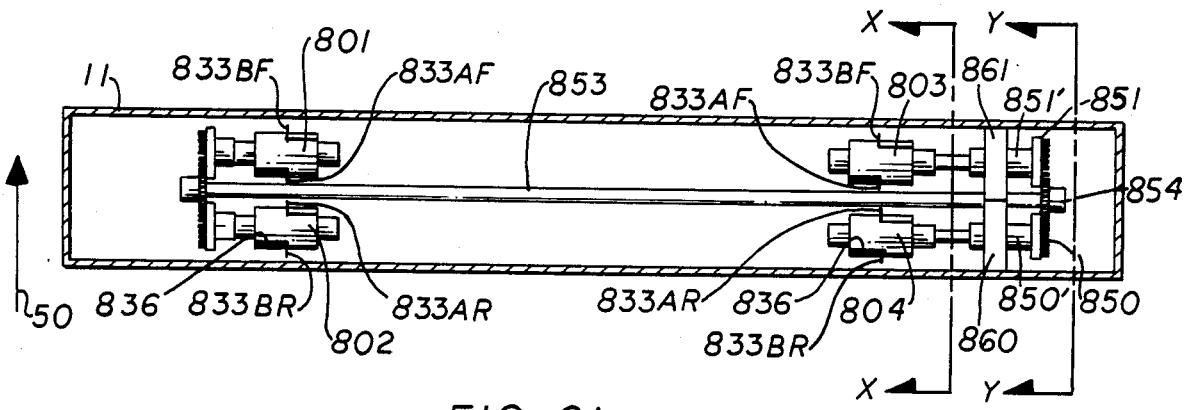
FIG. 21 is a top plan view of the head portion of a blind illustrating a variant on the invention to achieve the V-closure effect.
Figure 23:
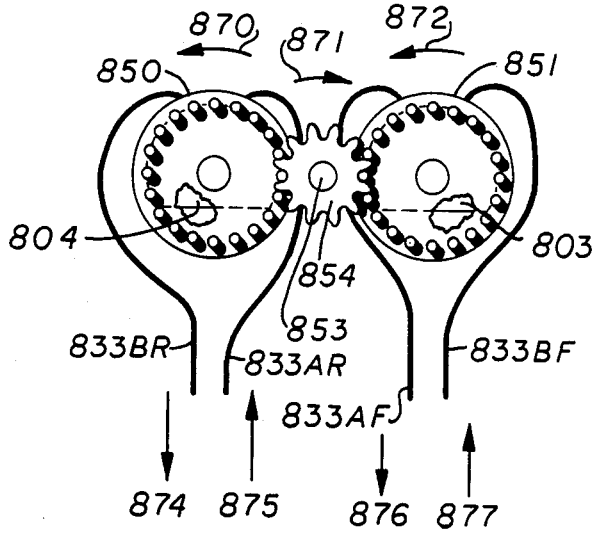
FIG. 23 is a diagrammatic view taken along line Y—Y of FIG. 21.

By utilizing a gear system, as shown in FIG. 23, and FIG. 21, wherein the spur gear 854 is mounted to the tilt rod 853 and the pin gears 850 and 851 are mounted on short rods 850′and 851″, the latter being retained by short rod mounts 860 and 861 secured in the head 11, and which short rods are engaged by the drums in the same manner as a tilt rod would be under standard blind construction to rotate the drum, the drums will rotate such that the front cable and the rear cable of the same ladder, such as the A ladder, move in opposite directions on movement of the tilt rod 853 in the direction shown by arrow 871, and the front cable of each ladder and the back cable of each ladder move in opposite directions as shown by direction arrows 874, 875, 876 and 877 respectively.

It should of course be understood that FIG. 23 is diagrammatic and as such depicts only the essential elements to enable the reader to understand the operation of the drums 804 and 803.

Figure 24:
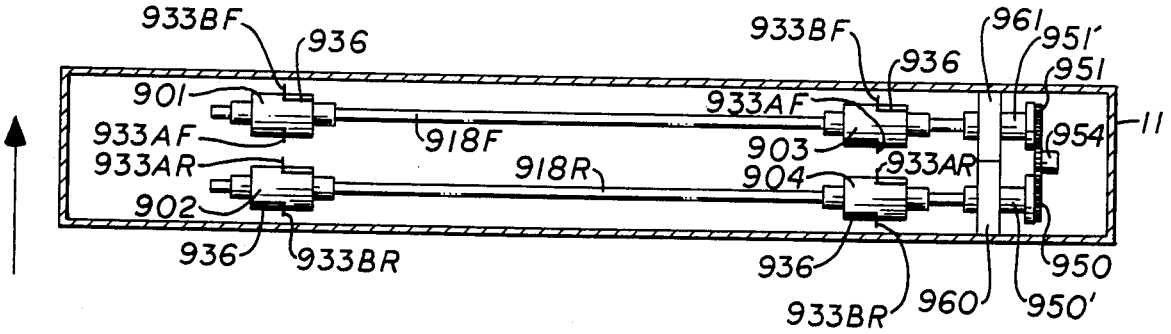
FIG. 24 is a top plan view of of the head portion of a blind employing the drum arrangement shown in FIG. 22.

Of course other arrangements are available to those skilled in the art to achieve the V-closure effect without utilizing the crossover effect as shown in FIG. 9B. One such arrangment is shown in FIG. 24. Here two tilt rods are employed one for each of the two drums shown at each end of the blind. The ladder cable's side cable mounting is carried out similarly to that employed with respect to the embodiment of FIGS. 22 and 23. That is, each of the A ladder's and each of the B ladder's two side cables are mounted on different drums and on different sides of the drum to which they are mounted. In this fashion each side of each ladder moves oppositely to the other side of that ladder. See direction arrows 874, 875, 876, and 877.

In this embodiment of FIG. 24, wherein 918F & R are the tilt rods, and the A ladder's side cables are designated 933 AF and 933 AR for the A front and rear respectively, and 933 BF and 933 BR for the B ladder front and rear respectively, it is seen that the relative arrangement is the same as that shown in FIG. 23 as discussed above.

Whereas two tilt rods and one tilter, not seen, are used here, and in the embodiment of FIG. 21 the gear system and one tilt rod are employed ,with both embodiments having the side cables of both the A and B ladders conventionally attached,both embodiments achieve the same V-closure effect. The gears are numbered 950, 54 and 51 and the tilter unseen, is connected to gear 954.

Figure 14:
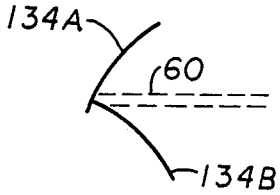
FIG. 14 is a closeup end view of a variant thereof, which variant is applicable to any drum, and tilt rod combination.

When adjacent slats close toward each other in what has been called the V-closure effect, under normal slat construction, a band of light 60 as per FIG. 13 will still show through between the adjacent slats when in the closed position But by modifying the slats, regardless of the drum configuration employed to achieve the V-closure the band of light passing between the closed adjacent slats can be eliminated. Reference is made to FIG. 14 which depicts this result. Note also the overlap of slat 134 A over slat 134 B.

For this superior closing, a notch is made in alternate slats at the point of impact of the cables of the ladders. These notches which extend inwardly about ⅛th inch or so from the edge of the slat, are placed on the down side of both of the A slat and the B slat. (The term A slat and B slat refer to the slats carried by the A ladder and B ladder respectively.)

Figure 15:
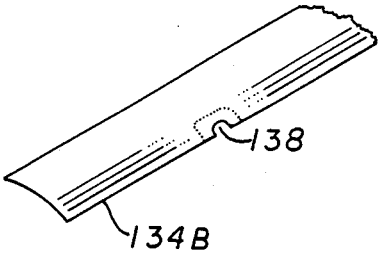
FIG. 15 is a top perspective view of a slat modified to achieve the variant closed position shown in FIG. 14.
Figure 16:
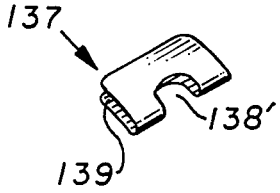
FIG. 16 is an enlarged perspective view of the element suitable for use in conjunction with the element of FIG. 15.
Figure 17:
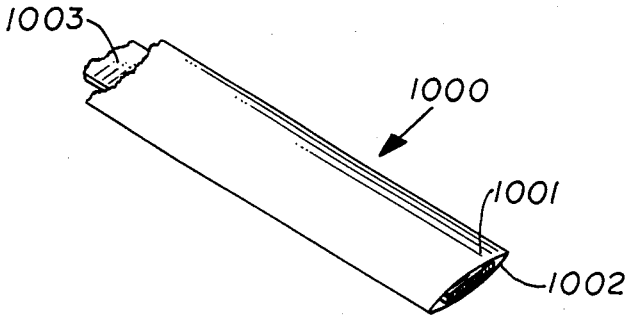
FIG. 17 is a perspective view of a double bottom rail rail employable herein.

In FIG. 15, slat 134B is shown modified according to this aspect of the invention. Thus a notch 138 is shown cut into slat 134B. A metal C-shaped clip 137 having a slot 138′ is shown in FIG. 16. This optional clip can be placed over notch 138 in the area shown by the dotted lines in FIG. 15 to align 138 and 138″ to strengthen the notched area of the slat and to keep the notch from propagating. The space 139 between each face of the clip 137 should be narrow enough to ensure a tight fit onto slat 134B. Clip 137 is formed preferably from spring steel to achieve a tight fit on the slat as was mentioned.

Since the notch and slot are aligned to coincide with the location of the ladder cable relative to the edge of the slat, the cable is thus permitted to move into the slot during such periods of closure thereby resulting in a tighter closing as per FIG. 14.

The optional clip is preferably employed at least on the top slat, i.e. just beneath the head section 11, and on the most lower slat, just above the bottom rail 12. This is because these are the key pressure zones of the ladder cables upon the slats.

Clips 137 are available in the marketplace for metal reinforcement from various manufacturers that are slotted for mounting on the sheets of metal.

In all of the various embodiments pertaining to the use single, double, and ½ function drums recited above, the one point that has been considered conventional is the tieing or otherwise securing or both ladders to the bottom rail. This may be accomplished by any of the known methods in the art, such as the use of knots and a plastic cap. This procedure is utilized in the manufacture of both standard mini-blinds and is suitable in most instances for the manufacture of V-closure blinds.

It should be understood that there are two markets for blinds, the mass market and the custom market. In the former, one buys a blind from a series of stock sizes that best approximates the size of the window. In the custom market, it is necessary to size the blind to fit the window. It is in the manufacture of custom blinds that difficulties can occur. In most blinds in today's market the vertical spacing between adjacent slats is approximately ⅝th inch. If the window is odd size, then the distance between the standard bottom rail and the first slat , which arbitrarily will be designated as a B ladder slat or B slat, will be reduced to as little as ⅛th inch. When one tries to rotate or close a V-closure blind wherein the first slat to bottom rail spacing is less than the spacing of the other slat to slat spacings, i.e. ⅝ths inch usually, there will be difficulty in achieving the V-closure at the very bottom of the blind.

I have now found a way to solve that problem as well to achieve a clean closure of the bottom of the V-closure blind. The problem is alleviated by utilizing double bottom rail system which comprises using the original or main bottom rail for on of said pair of latter cables and an upper bottom rail disposed up from said main bottom rail as the bottom rail for the second of said ladders. Generally the upper bottom rail is disposed as the 3rd slat from the main bottom rail, thereby enabling it to rest upon the rung of a cable ladder different from the bottom rail. Thus if the main bottom rail is for the B ladder, the upper bottom rail will be for the A ladder.

Figure 18:
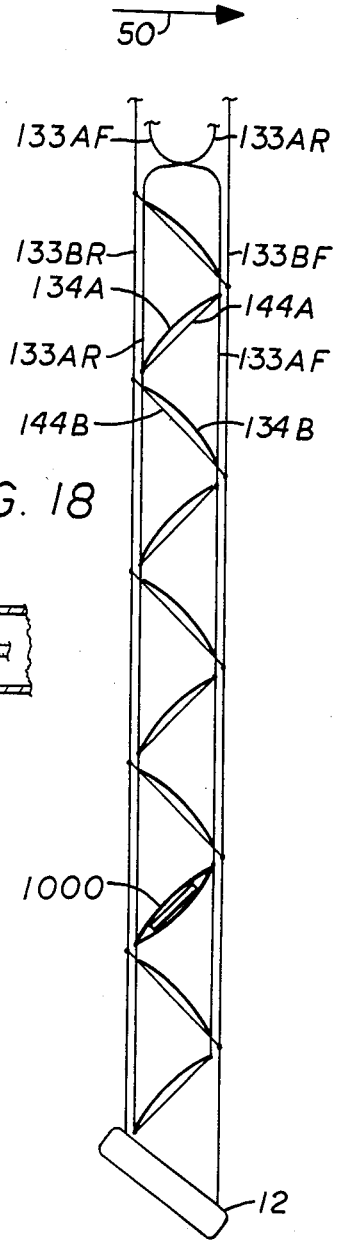
FIG. 18 is a diagrammatic view similar to FIG. 5 illustrating the use of the double bottom rail.

What happens in a custom blind, if both the A ladder and the B ladder of a V-closure blind are both tied to the main bottom rail, is that, as indicated above, the lower most slat of the blind might be as close as ⅝th inch from the main bottom rail. Now every other slat wants to tilt in an opposite direction from its next adjacent slat. Assume that the main bottom rail is to tilt up, and it is in the vertical ascent on the blind, equivalent to an A slat, the lower most slat, which is a B slat wants to tilt down, since it is tied in ladder wise to the bottom rail, and the second slat above the main bottom rail, being an A slat, also wants to tilt up, the lower most slat is caught in between due to the inadequate spacing between it and the main bottom rail, so it cannot tilt properly. But when the weight of the B ladder is not on the main bottom rail, as is shown in FIG. 18, the lower most slat floats and is pushed by the movement of the main bottom rail in the direction it should be tilting. The lower most slat only carries only its own weight and not that of the entire ladder, so it is easily influenced to tilt, even though only slightly, since there is inadequate room to fully tilt.

Since the weight of the upper bottom rail is preferably pre-established to be substantially the same as the weight of the main bottom rail, both ladders, the A ladder and the B ladder will stretch evenly during what is known as stretchout. Therefore the blind will always have a neat balanced appearance.

In my double rail system I utilize a special slat as the second bottom rail or upper bottom rail. It is positioned preferably as the third slat up from from the bottom, though any odd number standard slat can be substituted for by my upper bottom rail, other than the first slat.

The upper bottom rail 1000 comprises a pair of slats with a weight e.g. a steel bar interposed there between. Here, rail 1000 comprises a pair of arcuate slats, one of which is inverted, glued or otherwise secured to each other along the edges, with optional weighted bar 1003 interposed and secured between said slats.

Obviously it is recognized that in all of these embodiments there is no criticality as to which ladder supports the first slat moving away from the head. A and B are arbitrary choices.

The blinds of this invention can employ wood, metal or plastic slats , of any color, or of different colors such as by having a top of slat in one color and the bottom in another. The slats may be fabric covered if desired.

While the slats utilized today are slightly arcuate, and the embodiment that employs the modified slat as the upper bottom rail shows an arcuate unit for that reason, it is to be understood that flat wood slats are equally as applicable for use both as standard slats and for the upper bottom rail of this invention.

From a nomenclature point of view we have referred to the A ladder and the B ladder. In reality, each ladder will exist on at least each end of the blind, and if the blind is extremely wide extra ladders of both the A and B type will be necessary along the width of the blind. The ladder system, is thus seen to comprise the combination of the A ladder and the B ladder, with the number of each being purely arbitrary and readily determinable by those skilled in the art. Each ladder is mounted to a drum's cable mount slots as by the bead previously discussed for example.

No time has been spent discussing the tilter, which today is a single, usually plastic wand, that has replaced the tilting cord 17 as seen in FIG. 1. The tilter as is readily understood, is a means interconnected by a gear system—15, 16 of FIG. 1—to the tilt rod(s) upon which are mounted the at least one drum at each end of the width of the blind, for rotation of the drum, upon which rotation, the A and B cable ladders move to cause the front edge of any one slat to move upwardly or downwardly to the front edge of the next adjacent slat to thus effect the V-closure.

In the embodiments of FIGS. 11 and 12 the tilt gear system designated by numbers 315, and 415 respectively , are connected to a single tilter, not seen to rotate both tilt rods in the same direction to effect the V-closure. Whereas in the embodiment of FIG. 21, also seen in FIG. 23, a more sophisticated gear system is employed, in which gear 854 engages a gear attached to the unseen tilter, and moves the two tilt rods in different directions, yet achieves the same V-closure.

It is seen that I have provided improved blinds that combine the operation of mini-blinds with the appearance of high fashion pleated shades. At the same time, I have provided a blind that has a higher thermal coefficient in that in the closed position, especially with single pane glass, it will keep out the cold and the heat better than conventional blinds, be they the older style or current conventional mini-blinds. This is due to the tight adjacent slat closure to keep out the light , and thus the air gap as discussed above.

Since the bulk of all of these embodiments utilize conventional parts readily available in the industry , there has been no need for instance to discuss how to attach a tilter to a tilt rod. For this, while each manufacturer may have his own slight variation, the general mode of doing so is well known in the art. For the same reason, no time has been spent discussing the braiding of the cables in the preparation of the ladder cables. All of these components are readily available to blind assembly houses.

Thus the devices of this invention can be easily manufactured by those currently in the mini-blind business with a minimum of effort required to convert their manufacturing facility to do so.

Since certain changes may be made in the above devices without departing from the scope of the invention herein involved, it is intended that all matter contained in the above description and shown in the accompanying drawings shall be interpreted as illustrative and not in a limiting sense.

I claim:

1. A venetian blind having a head portion, at least one tilt rod , at least one drum on each end of the blind within said head portion , said at least one drum having a front cable mount slot and a rear cable mount slot and mounted for rotation by said at least one tilt rod and , a plurality of spaced slats, each of said slats having a front edge and a rear edge said slats being in a horizontal disposition when said slats are in a first or open position, and a cable ladder system mounted to said at least one drum, at least at opposite ends of of the width of said blind , said cable ladder system comprising a pair of ladders designated the A ladder and the B ladder, which ladders each have a pair of spaced vertical side cables, one of which is the front cable and the other of which is the rear cable, said front and rear cables being mounted to said at least one drum in said cable mount slots, said side cables being interconnected by spaced parallel rungs, the rungs connected to the side cables of each of the two ladders being space the spacing between two slats, one of the ladder's rungs being offset one slat space whereby the A ladder and the B ladder each support alternate slats between their side cables ;

means operatively connected to said at least one tilt rod to rotate said at least one drum and move said A ladder and said B ladder, such that the front cable of each of the two ladders moves in opposite directions, upwardly or downwardly, and the rear cable of each of the two ladders moves in opposite directions, upwardly or downwardly, and the front cable and the rear cable of each of the A and B ladders move in opposite directions, whereby when said at least one drum is rotated, all slats will move from the open position to a second or closed position in alternating movement, one upwardly and the next downwardly such that the front edge of any one slat moving in one direction, touches the front edge of the next adjacent slat moving in the opposite direction to effect a V-closure.

2. In the venetian blind of claim 1 wherein the at least one drum is a single dual function drum with both the A ladder and the B ladder mounted thereto.

3. A venetian blind having a head portion, at least one tilt rod, at least one drum on each end of the blind with said head portion, said at least one drum having a front cable mount slot and a rear cable mount slot and mounted for rotation by said at least one tilt rod and, a plurality of spaced slats, each of said slates having a front edge and a rear edge said slats being in a horizontal disposition when said slats are in a first or open position, and a cable ladder system mounted to said at least one drum, at least at opposite ends of of the width of said blind, said cable ladder system comprising a pair of ladders designated the A ladder and the B ladder, which ladders each have a pair of spaced vertical side cables, one of which is the front cable and the other of which is the rear cable, said front and rear cables being mounted to said at least one drum in said cable mount slots, said side cables being interconnected by spaced parallel rungs, the rungs connected to the side cables of each of the two ladders being spaced the spacing between two slats, one of the ladder's rungs being offset one slat space whereby the A ladder and the B ladder each support alternate slats between their side cables;

means operatively connected to said at least one tilt rod to rotate said at least one drum and move said A ladder and said B ladder, such that the front cable of each of the two ladders moves in opposite directions, upwardly or downwardly, and the rear cable of each of the two ladders moves in opposite directions, upwardly or downwardly, and the front cable and the rear cable of each of the A and B ladders move in opposite directions, whereby when said at least one drum is rotated, all slats will move from the open position to a second or closed position in alternating movement, one upwardly and the next downwardly such that the front edge of any one slat moving in one direction, touches the front edge of the next adjacent slat moving in the opposite direction to effect a V-closure wherein the at least one drum is a pair of single function drums, each of which drums has two side cables of ladders of the cable ladder system mounted thereto.

4. A venetian blind having a head portion, at least one tilt rod, at least one drum on each end of the blind within said head portion, said at least one drum having a front cable mount slot and a rear cable mount slot and mounted for rotation by said at least one tilt rod and, a plurality of spaced slats, each of said slats having a front edge and a rear edge said slats being in a horizontal disposition when said slats are in a first or open position, and a cable ladder system mounted to said at least one drum, at least at opposite ends of the width of said blind, said cable ladder system comprising a pair of ladders designated the A ladder and the B ladder, which ladder each have a pair of spaced vertical side cables, one of which is the front cable and the other of which is the rear cable, said front and rear cables being mounted to said at least one drum in said cable mount slots.

said side cables being interconnected by spaced parallel rungs, the rungs connected to the side cables of each of the two ladders being spaced the spacing between two slats, one of the ladder's rungs being offset one slat space whereby the A ladder and the B ladder each support alternate slats between their side cables;

means operatively connected to said at least one tilt rod to rotate said at least one drum and move said A ladder and said B ladder, such that the front cable of each of the two ladders moves in opposite directions, upwardly or downwardly, and the rear cable of each of the two ladders moves in opposite directions, upwardly or downwardly, and the front cable and the rear cable of each of the A and B ladders move in opposite directions, whereby when said at least one drum is rotated, all slats will move from the open position to a second or closed position in alternating movement, one upwardly and the next downwardly such that the front edge of any one slat moving in one direction, touches the front edge of the next adjacent slat moving in the opposite direction to effect a V-closure wherein the at least one drum is a quartet of ½ function drums with one side cable of one ladder of the cable system mounted on each of the drums.

5. In the venetian blind of claim 3 wherein the pair of single function drums are mounted spaced apart on a single tilt rod.

6. In the venetian blind of claim 3 wherein the pair of single function drums are each mounted on a separate tilt rod, and said tilt rods are vertically disposed with respect to each other.

7. In the venetian blind of claim 3 wherein the pair of single function drums are each mounted on a separate tilt rod, and said tilt rods are horizontally disposed with respect to each other.

8. In the device of claim 1 wherein the A ladder supports the top most slat.

9. In the device of claim 1 wherein the B ladder supports the top most slat.

10. In the device of claim 1 wherein the means operatively connected to the at least one tilt rod is a tilt wand

11. In the device of claim 2, where in the cable ladder system, one of said cable ladder's rear cable crosses under the drum and is mounted to the dual function drum's front cable mount slot, and the front cable of the said ladder crosses under the drum and is mounted to the dual function's drum's rear cable mount slot;

and in the other of said cable ladders of the system, the front cable is mounted to the front cable slot of the dual function drum and the rear cable is mounted to the rear cable slot of the drum.

12. In the device of claim 3 wherein each of the single function drums has two side cables of the same ladder mounted thereto.

13. In the device of claim 12 wherein the first of the cable ladder's rear cable crosses under its single function drum and is mounted to the front cable mount slot thereof, and the front cable of said cable ladder crosses under the single function drum and is mounted to the rear cable mount slot thereof;

and wherein the second of the cable ladder's rear cable is mounted to the rear cable mount slot of its single function drum , and the front cable of the second cable ladder is mounted to the front cable mount slot of the single function drum.

14. In the device of claim 3, wherein each of the single function drums has two side cables of different ladders mounted thereto.

15. In the device of claim 14, wherein both of the two cables are mounted in a cable mount slot on the same side of the drum.

16. In the device of claim 14 wherein each single function drum at one end of the blind is mounted on a separate tilt rod.

17. In the device of claim 14 wherein the two tilt rods holding the single function drums are vertically disposed with respect to each other.

18. In the device of claim 14 wherein the two tilt rods holding the single function drums are horizontally disposed with respect to each other.

19. In the device of claim 16 wherein the two tilt rods each containing a single function drum at each end of the blind rotate in the same direction upon actuation of the means operatively connected to rotate said drum.

20. In the device of claim 16 wherein the two tilt rods each containing a single function drum at each end of the blind rotate in opposite directions upon actuation of the means operatively connected to rotate said drum.

21. In the device of claim 3 wherein one tilt rod is engaged to each of the two single function drums by a gear system whereby upon actuation by a tilt wand connected to said gear system, the two drums rotate in opposite directions.

22. A venetian blind having a head portion, one tilt rod , one drum on each end of the blind within said head portion , said one drum having a front cable mount slot and a rear cable mount slot and mounted for rotation by said one tilt rod and , a plurality of spaced slats, each of said slats having a front edge and a rear edge said slats being in a horizontal disposition when said slats are in a first or open position, and a cable ladder system mounted to said at least one drum, at least at opposite ends of of the width of said blind , said cable ladder system comprising a pair of ladders designated the A ladder and the B ladder, which ladders each have a pair of spaced vertical side cables, one of which is the front cable and the other of which is the rear cable, said front and rear cables being mounted to said one drum in said cable mount slots, said side cables being interconnected by spaced parallel rungs, the rungs connected to the side cables of each of the two ladders being spaced the spacing between two slats, one of the ladder's rungs being offset one slat space whereby the A ladder and the B ladder each support alternate slats between their side cables ;

means operatively connected to said one tilt rod to rotate said one drum and move said A ladder and said B ladder, such that the front cable of each of the two ladders moves in opposite directions, upwardly or downwardly, and the rear cable of each of the two ladders moves in opposite directions, upwardly or downwardly, and the front cable and the rear cable of each of the A and B ladders move in opposite directions, whereby when said one drum is rotated, all slats will move from the open position to a second or closed position in alternating movement, one upwardly and the next downwardly such that the front edge of any one slat moving in one direction, touches the front edge of the next adjacent slat moving in the opposite direction to effect a V-closure.

23. In the venetian blind of claim 4 wherein all of the ½ function drums are mounted on one tilt rod.

24. In the device of claim 1 wherein each slat has at least one notch therein directed inwardly from the edge of the slat, along the width thereof, and each adjacent slat has the notch on the opposite edge from that of the next adjacent slat, said notches being spaced along the width of the slat equidistant to the spacing of the ladder cables.

25. In the device of claim 24 wherein at least the top slat's notch is reinforced by a C-shaped clip surrounding said notch.

26. An improved venetian blind having slats, drums, at least one tilt rod upon which the drums are mounted for rotation by a means operatively connected to tilt said tilt rod, said blind including a cable ladder system having two cable ladders, each of which ladders has two side cables; namely front and a rear cable, said ladders supporting said slats, said drums having front and rear cable mounting slots, wherein one of the cable ladder's front cable is attached to a drum's rear cable mount slot and the rear cable thereof is attached to the front cable mount slot of a drum;

and the other cable ladder's front cable is attached to a drum's front cable mount slot, and the rear cable thereof is attached to a drum's rear cable mount slot.

27. In the blind of claim 26, wherein each slat has a notch on either the front or rear edge thereof adjacent the ladder supporting said slat.

28. In the blind of claim 27 , wherein some of the notches are reinforced by C shape clips mounted on the slats.

29. In the blind of claim 1, wherein an even numbered slat beyond the first slat above the main bottom rail is replaced by an upper bottom rail, of similar weight to the main bottom rail.

30. In the blind of claim 29 wherein the upper bottom rail comprises a pair of arcuate blind slats, one of which is inverted, and secured to the underside of the first blind slat.

31. In the blind of claim 30 , wherein a weighted bar is interposed within the spacing between the two blind slats.

32. A new ladder system for use in a V-closure venetian blind, adapted to be mounted on at least one drum in the cable mount slots of said at least one drum, which drum would be disposed within the blind's U-channel head, which ladder system comprises a pair of cable ladders, each cable ladder being comprises of a pair of vertical side cables and a plurality of space rungs normal thereto, the spacing between adjacent rungs in each cable ladder being the same, with adjacent ladders in one of said cable ladders being offset in the vertical direction 50% of the distance between any two adjacent rungs in the other of said cable ladders.

33. A ladder system for use in V-closure blinds, which blinds have a plurality of vertically spaced slats, which ladder system includes a pair of cable ladders, each of which cable ladders includes a plurality of spaced rungs, and each of which cable ladders is adapted to support alternate slats of the blind on its rungs.

* * * * *